United States Patent [19]

Kemeny et al.

[11] Patent Number: 4,841,181

[45] Date of Patent: Jun. 20, 1989

[54] ELECTROMAGNETIC LAUNCHER WITH POST-FIRING ENERGY RECOVERY FOR SLOW OR RAPID FIRE OPERATION

[75] Inventors: George A. Kemeny, Wilkins Township, Allegheny County; Daniel W. Deis, Churchill Boro, both of Pa.

[73] Assignee: Westinghouse Electric Corp., Pittsburgh, Pa.

[21] Appl. No.: 121,011

[22] Filed: Nov. 16, 1987

[51] Int. Cl.[4] ..... H02K 41/00

[52] U.S. Cl. ..... 310/12; 318/135; 124/3

[58] Field of Search ..... 310/12, 13, 15, 20; 318/135; 124/3

[56] References Cited

U.S. PATENT DOCUMENTS 4,319,168 3/1982 Kemeny ..... 318/135
4,572,964 2/1986 Honig ..... 124/3 X
4,714,003 12/1987 Kemeny ..... 310/12 X
4,718,321 1/1988 Honig et al. ..... 124/3 X
4,738,181 4/1988 Graden ..... 310/12 X
4,753,153 6/1988 Jasper, Jr. ..... 310/12 X

OTHER PUBLICATIONS

Honig, E. M., "Switching Considerations and New Transfer Circuits for Electromagnetic Launch Systems", IEEE Transactions on Magnetics, Mar. 1984, pp. 312–315.

*Primary Examiner*—William M. Shoop, Jr.
*Assistant Examiner*—Marc S. Hoff
*Attorney, Agent, or Firm*—D. Schron

[57] ABSTRACT

An electromagnetic launcher system which includes a homopolar generator pulse power supply recovers post-launch rail inductive energy and transfers it to the rotor of the homopolar generator to increase its kinetic energy for use in one or more subsequent launchings.

13 Claims, 7 Drawing Sheets

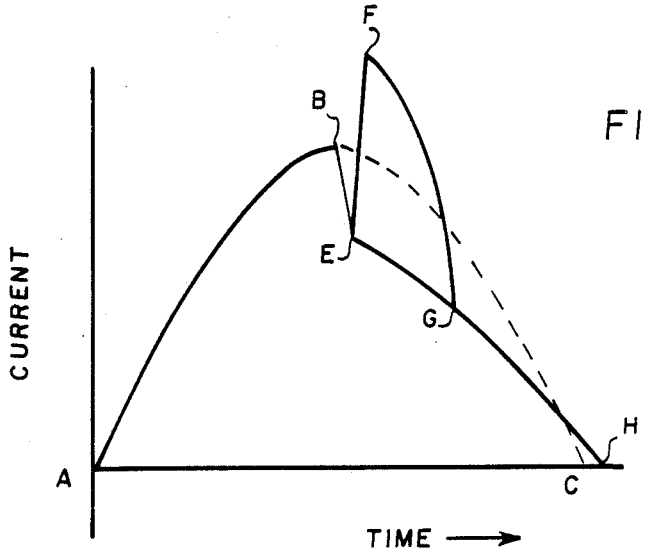
FIG. 3
FIG. 5
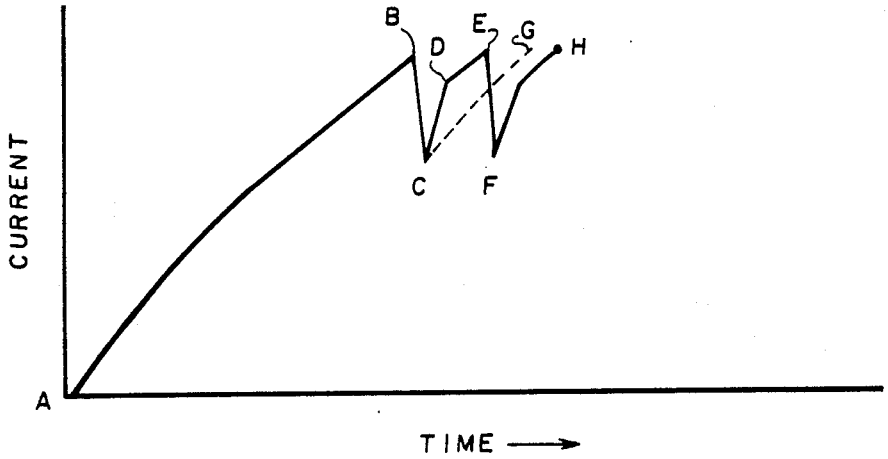

ELECTROMAGNETIC LAUNCHER WITH POST-FIRING ENERGY RECOVERY FOR SLOW OR RAPID FIRE OPERATION

BACKGROUND OF THE INVENTION

1. Field of the Invention

The invention in general relates to electromagnetic launcher systems, and particularly to an arrangement which recovers post-firing energy and stores it, in a novel manner, for use in subsequent launchings.

2. Description of the Prior Art

An electromagnetic launcher basically consists of a power supply and two generally parallel electrically conducting rails between which is positioned an electrically conducting metallic armature. Current from the power supply is commutated into the rails and flows down one rail, through the armature and back along the other rail whereby a force is exerted on the armature to accelerate it, and a payload, so as to attain a desired muzzle or exit velocity. Current conduction between the parallel rails may also be accomplished by an armature in the form of a plasma or arc which creates an accelerating force on the rear of a sabot which in the bore length supports and accelerates the projectile.

In one common type of electromagnetic launcher, the power supply is comprised of a direct current machine, for example, a homopolar generator in series with an inductive energy storage device. A firing switch is electrically connected to short the breech end of the rails and is in series with the power supply. Prior to firing a projectile, the rotor of the homopolar generator is driven to a desired rotational speed at which point, with the firing switch in the closed position, current flow is established through the storage inductor. When the current through the inductor reaches a predetermined firing level, the firing switch is opened to commutate current into the projectile launching rails.

With such an arrangement, the post-launch inductive energy remaining the in rail system can be almost equal to the kinetic energy of the projectile and recovery and effective utilization of this energy for subsequent launches greatly increases energy efficiency and reduces energy losses which must be dissipated. Typically, this energy may be transferred to an inductive storage arrangement or a capacitive storage arrangement. With inductive storage, launcher operation must be in a rapid fire mode because of the inability of all but superconducting inductors to efficiently store energy for relatively long intervals. Although capacitive energy storage arrangements allow longtime intervals between launches, such capacitive storage systems are of enormous mass and volume and may be prohibitively expensive for certain tactical situations.

The present invention allows for both rapid fire and relatively longer fire scenarios without the requirement of massive capacitive storage arrangements.

SUMMARY OF THE INVENTION

An electromagnetic projectile launcher, in accordance with the present invention, comprises a source of high current which includes a generator and energy storing inductance in series with the generator. A rail system including at least one pair of generally parallel conducting rails having a breech end and a muzzle end is connected to the source of high current and an armature for conducting current bridges the rails for accelerating a projectile when a high current from the source is commutated into the rails. Means are provided for recovering inductive energy remaining in the rail system after a launch and this recovered energy is transferred back to the generator to increase the kinetic energy of the rotor thereof prior to a subsequent launch.

BRIEF DESCRIPTION OF THE DRAWINGS

FIG. 3 illustrates waveforms associated with the operation of the apparatus of FIG. 2;

FIG. 5 illustrates the waveforms associated with the operation of the apparatus of FIG. 4.

DESCRIPTION OF THE PREFERRED EMBODIMENT

Figure 1:
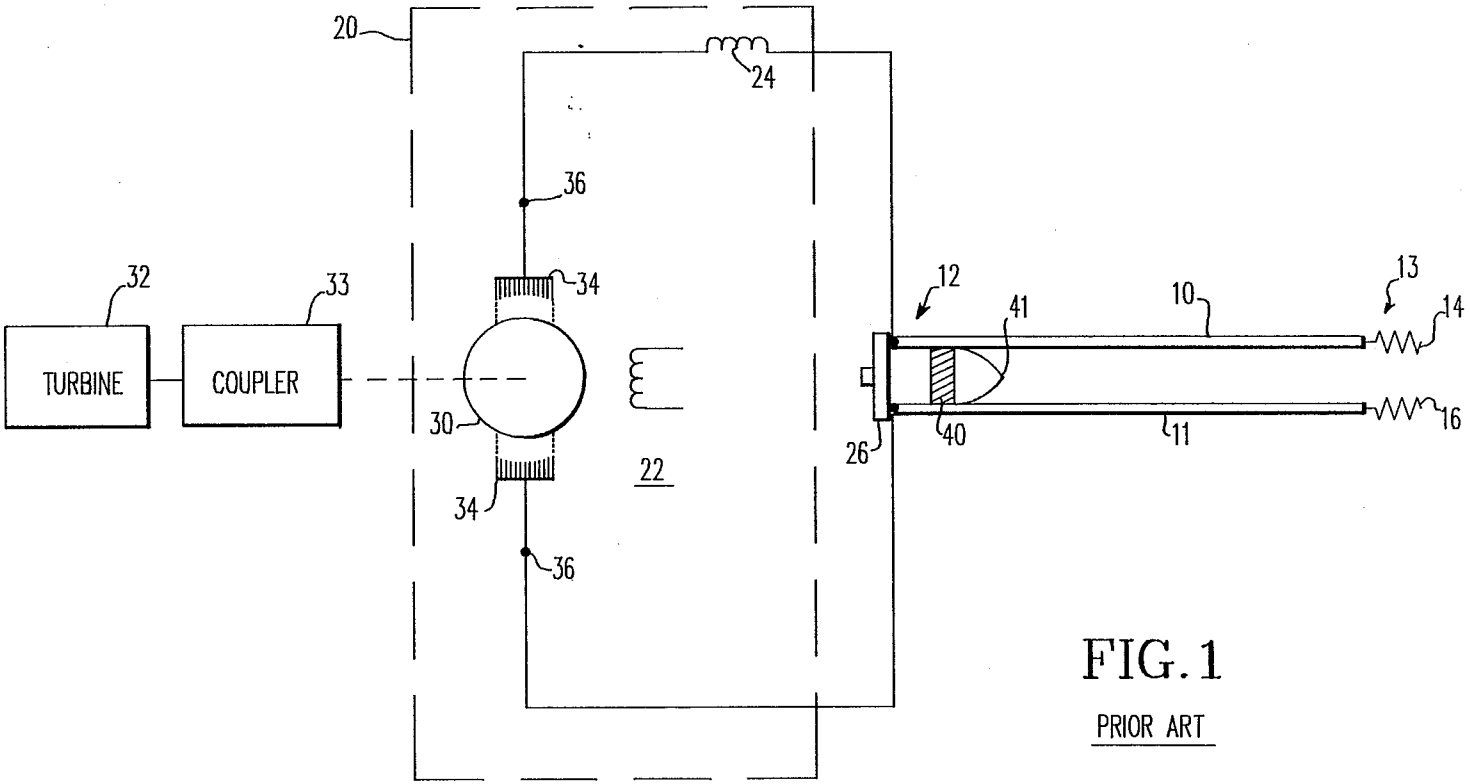
FIG. 1 PRIOR ART
FIG. 1 illustrates the basics of a typical prior art electromagnetic launcher.

A typical electromagnetic launcher, as depicted in FIG. 1, includes a rail system comprised of electrically conducting generally parallel rail members 10 and 11 having a breech end 12 and a muzzle end 13, the latter end including resistive rail segments 14 and 16 at the ends of respective rails 10 and 11.

The breech end 12 is connected to a high current source 20 which includes a homopolar generator 22 in series with energy storing inductance means such as storage inductor 24. The series connection includes a firing switch 26 which is in a closed condition shorting out the breech end of rails 10 and 11 prior to a launch. The homopolar generator 22 includes a rotor member 30 connected to a prime mover such as turbine 32 by way of a coupling arrangement 33. When the turbine-driven rotor 30 has attained a predetermined rotational speed, all or fraction of the kinetic energy thereof is transferred to the inductor 24 where it is temporarily stored as electrical energy. In one typical homopolar generator arrangement this transfer may be accomplished by bringing movable electrically conducting brushes, represented by numerals 34, into contact with the rotor, thus electrically connecting the homopolar generator 22 with inductor 24 via terminals 36. Alternatively, or in addition, a make switch could be incorporated in the loop.

During the inductor charging cycle, firing switch 26 remains in a closed condition and when the magnitude of the inductor current reaches an appropriate firing level, switch 26 is opened and current is commutated into rails 10 and 11, bridged by an electrically conducting armature 40. Upon the opening of switch 26 current flows down one rail, through the armature and back along the other rail such that the current flowing in the loop exerts a force on the armature 40 to accelerate and launch a projectile 41.

The accelerating force, in essence, is a function of the magnetic flux density and current density vectors, and since the current flowing in the rails is often measured in millions of amperes, projectile 41 exits the muzzle end 13 of the rail system at exceptionally high velocities measurable in kilometers per second.

As the projectile exits from the rails, firing switch 26 is closed and inductive energy, which may approach in magnitude the kinetic energy of the launch projectile package, remains in the rail system to be either dissipated, for example by resistors 14 and 16, and a muzzle shunting arc, or to be recovered for use in a subsequent launch.

In the present invention post-launch rail inductive energy is transferred to the homopolar generator to increase the kinetic energy of the rotor thereof and, depending upon the system design, the arrangement can be utilized for rapid or burst fire wherein the time between launchings is quite short, for example, a few tens of milliseconds, or it can be used for relatively slower rate launchings where the interval is many hundreds of milliseconds to seconds.

Figure 2:
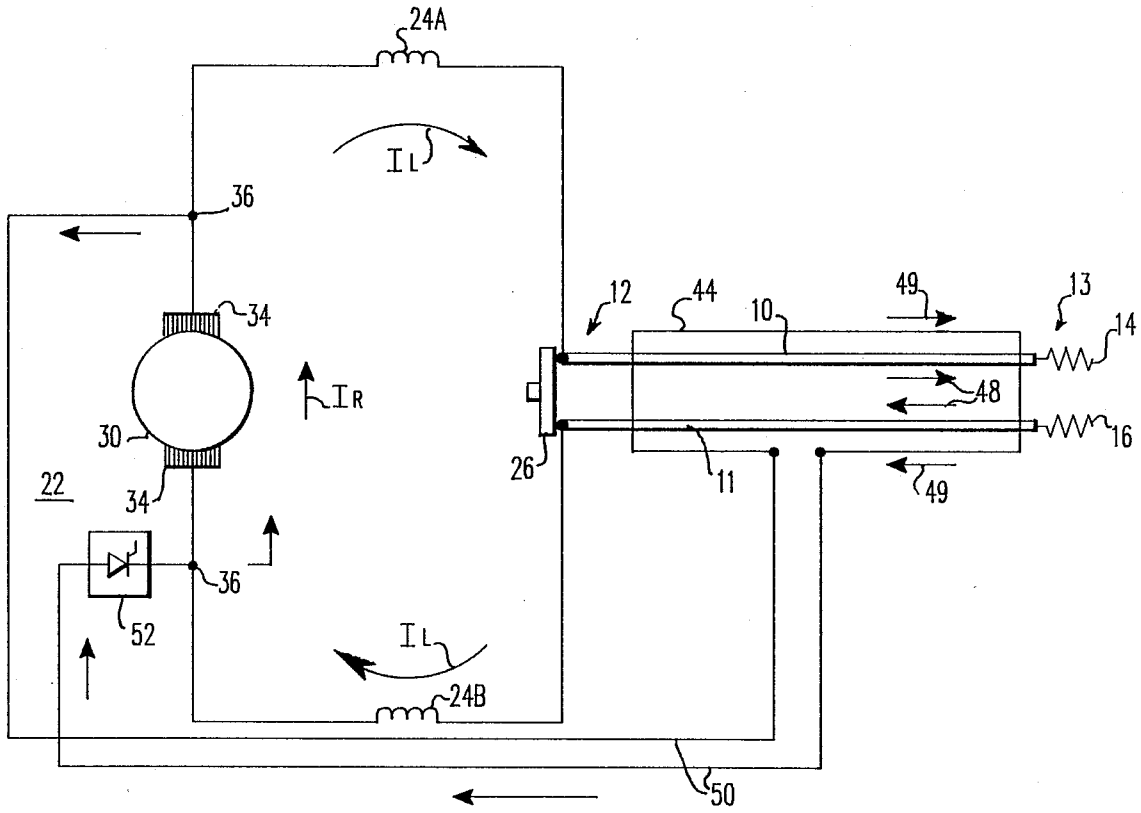
FIG. 2 illustrates an electromagnetic launcher arrangement in accordance with one embodiment of the present invention.

One embodiment of the present invention is illustrated in FIG. 2 wherein components corresponding to those in FIG. 1 have been given the same reference numerals. For current balancing, grounding, and symmetry purposes, the storage inductor has been divided into two parts, 24A and 24B, although in an actual physical construction, the two windings can be adjacent one another in the same inductor assembly. This inductance division is particularly beneficial for later FIG. 6 and FIG. 7 configurations.

In the embodiment of FIG. 2, post-launch inductive energy remaining in the rail system is recovered by means of a loop or winding 44 which extends substantially the entire length of the rails 10 and 11 and is in intimate flux-linking relationship therewith. When the projectile (not illustrated) reaches the muzzle end of the rails, firing switch 26 is closed to prevent further energy addition into the rails from storage inductor 24A,B. As the projectile exits, there is a voltage drop in the rail loop proportional to the summation of rail pair resistance; switch 26 resistance; muzzle resistive rail segments 14 and 16 resistance; and the resistance of the arc which is normally drawn across the rails during projectile exit. These resistances produce an adequately high net voltage drop in the projectile rail loop, causing the rail current, indicated by arrows 48, to rapidly drop and the current in winding 44, as indicated by arrows 49, to correspondingly increase, such that the magnetic energy remaining in the rail system after the launch is inductively and effectively transferred to the winding 44.

The recovered energy is transferred back to the homopolar generator 22 by means of very low inductance cabling 50 connected by way of example to the terminals 36 of the homopolar generator. With the particular connections illustrated in FIG. 2, recovered current in winding 44 is injected into the rotor 30 upon activation of controlled switching means 52 which typically may be an array of parallel thyristors.

In the scenario of FIG. 2, the kinetic energy storage of rotor 30 driven by the prime mover (not illustrated) is sufficient for only a single launch. In such instance, and as indicated by arrow $I_R$, current is returned to the rotor in the same direction as current $I_L$ supplied to the storage inductor loop. Although the received current will also tend to flow through the storage inductor path, this path presents an inductive and ohmic impedance which is orders of magnitude greater than that of the rotor and therefore substantially the total current $I_R$ will flow in the rotor loop only.

The operation may be explained with further reference to FIG. 3 which illustrates certain currents as a function of time. At point A the rotor has been revved up to the desired operating speed and the brushes 34 are activated into contacting the rotor surface. Current buildup through the storage inductors 24A,B is indicated by the curve portion from A to B, the latter being the proper firing current level. At point B the rotor has delivered substantially all of its energy to the storage inductor and is at a virtual standstill.

If a launch is aborted, firing switch 26 remains in a closed condition and all of the inductive energy stored in inductor 24, minus losses, is returned to the rotor 30 which accelerates in a reverse direction. At the current zero point C, brushes 34 are lifted and or a switch is opened and the remaining system energy in the form of kinetic energy is stored in the reverse rotating rotor, with the current variation being approximated by the dotted line portion from B to C in FIG. 3.

If the launch is not aborted, when the current reaches the appropriate firing level at point B, firing switch 26 is opened, producing a very rapid current drop during launch from B to E. In the absence of any rail inductive energy recovery and after reclosure of switch 26, the homopolar generator is driven as a motor by the remaining inductive energy in inductive storage 24A,B and attains its maximum kinetic energy recovery at approximately point H, although the remaining kinetic energy and rotational speed is far less than if the launch were aborted.

With the present invention, however, after firing, and at point E, when switch 26 is reclosed and switch means 52 is activated, rotor current increases from point E to point F due to the energy recovery by the provision of winding 44. Rotor 30 which is now in the motoring phase is being driven by both current supplied by storage inductor 24A,B and the additional current in the same direction supplied by the energy recovery winding 44.

In general, the self-inductance of the loop including winding 44, cabling 50 and the homopolar generator 22 is much less than the inductance of the storage inductor 24A,B and accordingly energy from the loop 44 will be discharged at a faster rate as approximated by the curve from point F to G, point G representing the point at which the transferred current in winding 44 will go through zero, at which time controlled switching 52 is opened. At a point such as H when the current through storage inductor 24A,B also goes through zero, the kinetic energy of rotor 30 has been significantly increased and can be utilized for a subsequent launching, which now requires a smaller additional percentage of kinetic energy make up to attain the rotational speed required for a successive launch. If a bidirectional rotor accelerating system is provided, the next launch may occur when the required speed in the opposite direction is attained. Alternatively, a longer extended pause between launchings may be accomplished after attainment of the proper speed by continuing to supply a small amount of makeup energy equal to the rotationally induced losses.

Figure 4:
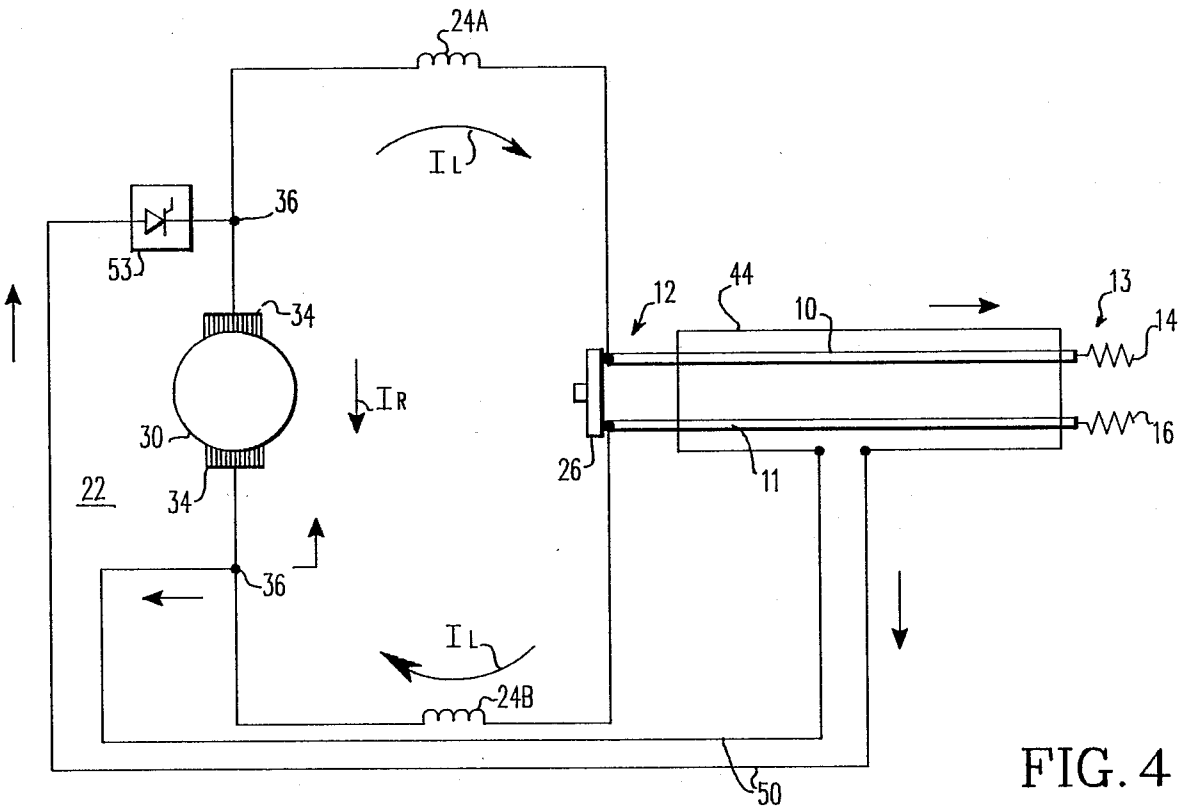
FIG. 4 illustrates the arrangement of FIG. 2 utilized in a rapid fire mode of operation.

FIG. 4 illustrates the apparatus of FIG. 2 with particular connections for a rapid burst fire scenario in which case the homopolar generator may be of the type which is capable of storing sufficient kinetic energy to rapidly fire the desired burst of shots. In the rapid burst mode of operation, the connections are such that recovered current is passed through the rotor in a direction opposite to the current supplied to or by the storage inductor. Accordingly, the connection from winding 44 to the homopolar generator terminals 36 are opposite to that illustrated in FIG. 2 and a different controlled switching means 53 is provided.

Burst fire operation can be explained with additional reference to FIG. 5. After the appropriate rotational speed of the rotor 30 has been attained, brushes 34 are brought into contact with the rotor thereby causing the transfer of energy in the form of current to the storage inductor 24A,B, as indicated by the curve from points A to B. At point B, firing switch 26 is opened, causing a rapid reduction in current during the launch to point C. If the post-launch rail inductive energy is not recovered, current buildup after reclosure of switch 26 will be as approximated by the dotted line portion of the curve from C to G. If the post-launch rail inductive energy is recovered, then this is accomplished by transferring it back to the homopolar generator and the oppositely directed current component $I_R$ through the rotor reduces the net current therethrough. The generator sees a lower net current which has the effect of reducing the electrical resisting or reaction torque so that the prime mover revs up the rotor at a faster rate or so that the rotor looses less speed while current again increases to launch level.

Although the rotor will slow down between launches, it will not slow down as much as it would have without the energy recovery and the current buildup is at a faster rate, as indicated by the curve from point C to D. At point D all of the post-launch rail inductive energy has been recovered, $I_R$ has gone to zero, and the current from point D to E increases at the normal rate similar to A to B. At point E a subsequent launching may take with a similar recovery as previously explained so as to be ready for a next launch at point H, such launchings taking place within tens of milliseconds of one another, for example.

Figure 6:
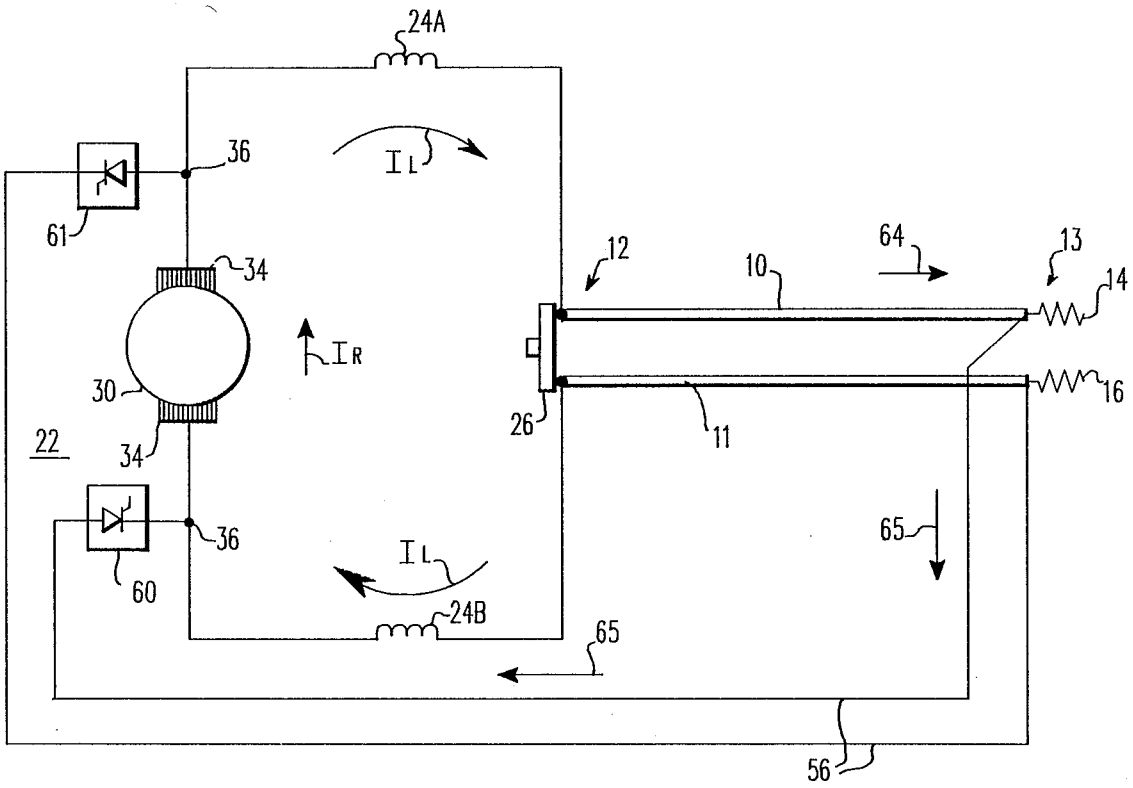
FIGS. 6, 7, and 8 are electromagnetic launcher systems in accordance with other embodiments of the present invention.

FIG. 6 illustrates an arrangement for transferring post-launch energy to a homopolar or DC generator without the requirement for a separate flux-linking loop such as winding 44 in FIG. 2. In FIG. 6 low inductance high current cabling 56 directly connects the ends of rails 10 and 11 with respective terminals 36 of the homopolar generator 22. In view of the fact that there is a direct metallic connection of the cable with the rails, controlled switching means 60 and 61 are provided in respective lines of the cabling 56 to prevent any possible parasitic currents. With rail and cable current in the respective directions as indicated by arrows 64 and 65, the particular connections to the homopolar generator are for a lower rate of fire such as described with respect to FIG. 2. Accordingly, the recovered current passes through the rotor in the direction as indicated by arrow $I_R$.

After acceleration, and when the projectile is at or near the muzzle, firing switch 26 is closed and controlled switching means 60 and 61 are activated to pass current. As the projectile exits the rails a sufficiently high voltage is generated across the resistive ends of the rails and by a muzzle shunting arc, the effect of which voltage is to rapidly and efficiently commutate the current flowing in the rails to also flow into the low inductance cabling 56. This has the effect of increasing the net rotor current, thereby converting most of the remaining energy in the rail system into a rotor kinetic energy increase available for a successive firing, as previously described. For a rapid or burst fire mode of operation, the low inductance cabling connections to the homopolar generator terminals would be reversed.

Figure 7:
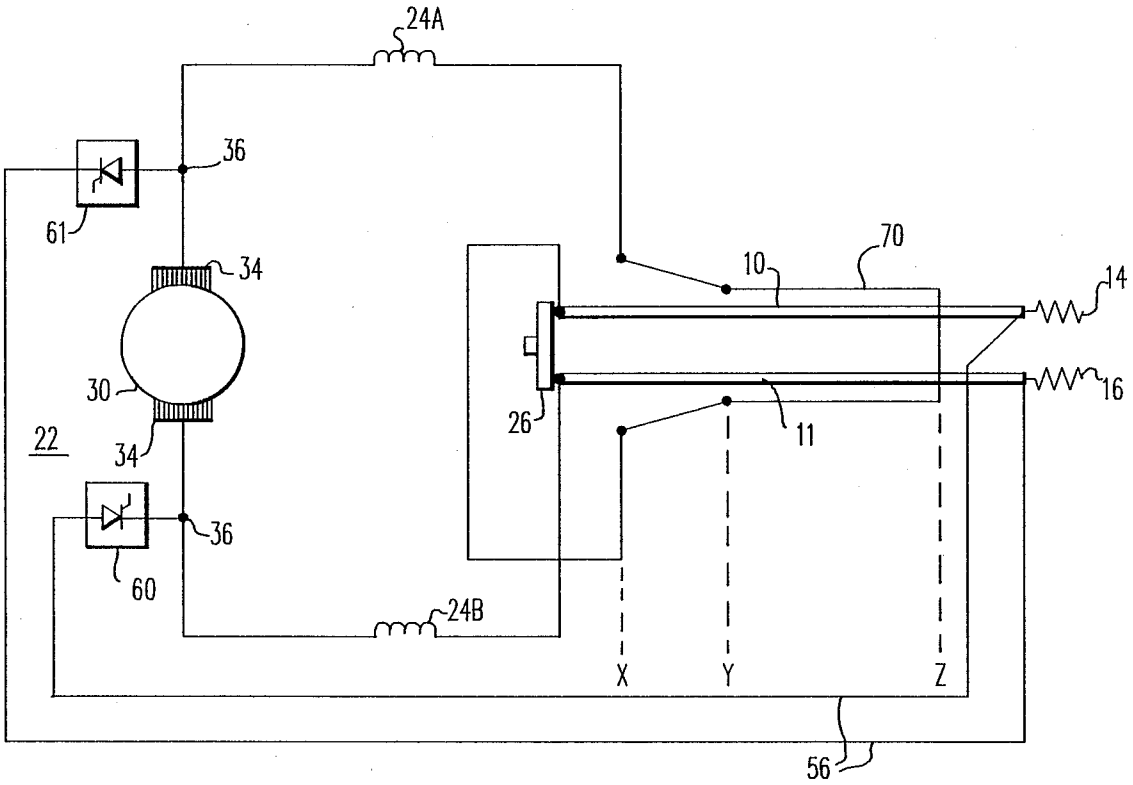

Some prior art electromagnetic launcher arrangements include the use of an augmenting winding in close flux-linking relationship with the rails over the entire length thereof and in series circuit relationship with the storage inductor. Post-launch rail inductive energy is inductively transferred into the augmenting winding and is utilized to assist in accelerating the next projectile in a rapid fire situation. Under certain conditions it would be desirable to augment the rail flux over only a portion of the rail bore length; however, under such circumstances the efficiency of the prior art energy recovery is seriously diminished if the entire bore length is not linked. In the present invention a partial augmentation may be accomplished, one example of which is illustrated in FIG. 7.

As can be seen, the augmenting winding 70 is in close flux-linking relationship with the rails 10 and 11 only from position Y to position Z. With such augmentation over only a fraction of the rail bore length, high efficiency inductive recovery of the post-launch inductive rail bore energy is unattainable. Much more efficient operation will be attained with the FIG. 7 connections since energy not recovered by the augmenting winding 70 will be commutatively transferred to the homopolar generator by cabling 56 to increase the kinetic energy of the rotor thereof.

In addition, the augmenting configuration without handicapping energy recovery may be tailored to match predetermined projectile acceleration requirements such as illustrated by the augmenting winding section from position X to position Y which shows a varying and increasing flux-linking relationship. Operation in a burst or rapid fire mode can be accomplished with the arrangement of FIG. 7 by interchanging the low inductance cabling connections to the rotor terminals, as previously described.

Figure 8:
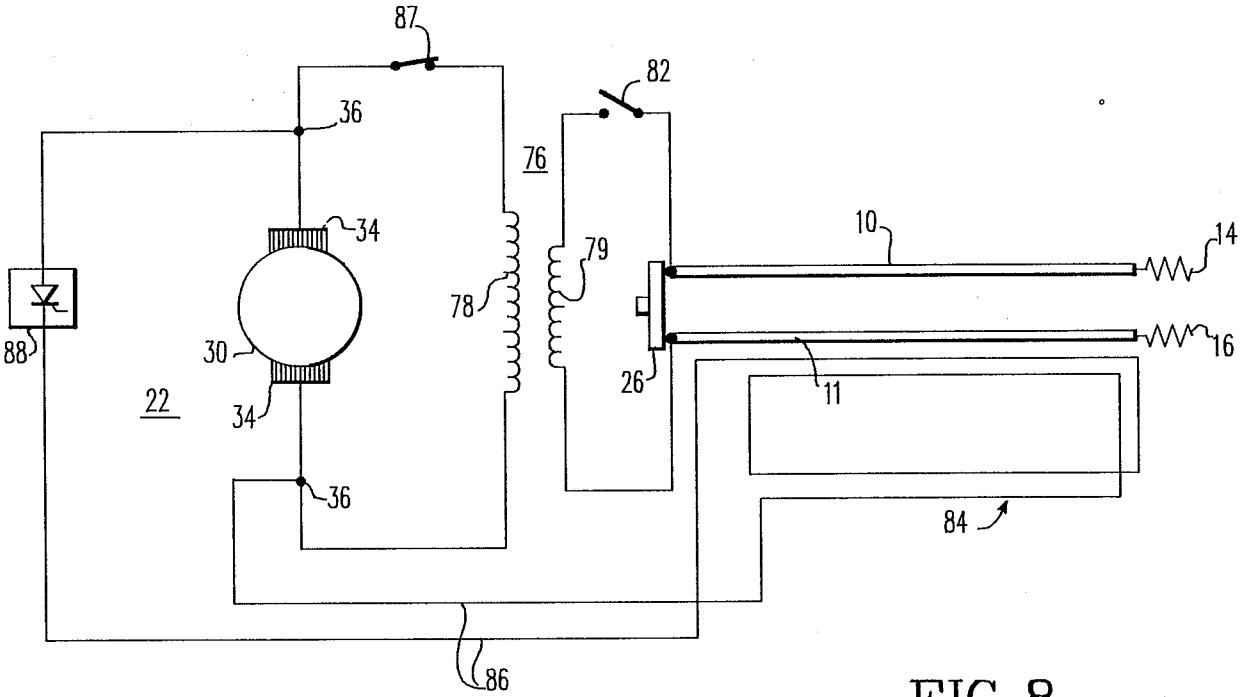

FIG. 8 illustrates an electromagnetic launcher system which includes a magnetic energy storage pulse transformer 76 typically utilized to reduce the magnitude of current required to be provided by the homopolar or DC generator and to step up this current in a secondary loop for projectile launching.

In operation, when the desired rotor speed has been attained, brushes 34 are brought into contact with the rotor and with circuit breaker 87 in a closed position charging up of primary inductor 78 commences. During the charging process, switch 82 maintains the secondary loop including secondary inductor 79 in an opened condition. When the proper current magnitude is attained in the primary loop, switch 82 is closed, the primary loop current is interrupted by opening breaker 87, and highly efficient transfer of current and energy to the secondary loop takes place, provided the primary and secondary inductors are in intimate flux-linking relationship. After completion of energy transfer to the secondary loop and interruption of current in the primary loop, firing switch 26 is opened to launch the projectile.

Although post-launch pulse transformer secondary inductive energy can be efficiently transferred back to the primary inductor 78, after closure of firing switch 26, closing 87 and opening of switch 82, concurrent rail inductive energy transfer may be achieved in accordance with the present invention by the provision of energy transfer winding 84 in close flux-linking relationship with the rails and connected across the homopolar generator terminals 36 by means of low inductance cabling 86 and controlled switching means 88.

The arrangement including winding 84 returns the post-launch rail energy directly back into the rotor 30 however, to make the current magnitude acceptable for the rotor current rating, winding 84 must step down the current level by approximately the same factor as it was stepped up by the magnetic energy storage pulse transformer 76. Accordingly, the energy transfer winding 84 must include a number of series connected loops.

Accordingly, there has been described apparatus, and a procedure, for recovering a major fraction of the post-launch rail inductive energy in an electromagnetic launching system. The recovered energy is used to add an increment of rotational speed to the kinetic energy storing rotor of the pulse machine which stores and provides the system energy. Recovery of this energy is accomplished in an efficient manner and allows for rapid or burst fire modes of operation measurable in tens of milliseconds between shots or for relatively slower rates of fire measurable in seconds.

We claim:

1. Electromagnetic projectile launcher apparatus comprising:

(a) a source of high current including energy storing inductance and a generator in series with said inductance and including a rotor and rotor terminals;

(b) a rail system including first and second generally parallel, conducting rails having a breech end and a muzzle end;

(c) an armature for conducting current between said rails and for accelerating a projectile along said rails;

(d) switch means connected to said breech end to initiate injection of said high current into said rails and armature whereby said projectile is launched out said muzzle end;

(e) means for recovering inductive energy remaining in said rail system after a launch; and (f) means for transferring said recovered energy back to said generator to increase the kinetic energy of said rotor to a level above that which it would have without said recovery of energy.

2. Apparatus according to claim 1 wherein:

(a) said means for recovering includes a winding in flux-linking relationship with said rails; and (b) said means for transferring includes relatively low inductance cabling connecting said winding with said rotor terminals, and controlled switch means for electrically completing said connection.

3. Apparatus according to claim 2 wherein:

(a) current induced in said winding is caused to flow through said rotor in the same direction as provided by said generator to said energy storing inductance.

4. Apparatus according to claim 2 wherein:

(a) current induced in said winding is caused to flow through said rotor in the opposite direction as provided by said generator to said energy storing inductance.

5. Apparatus according to claim 1 wherein:

(a) said means for recovering inductive energy and transferring said recovered energy includes relatively low inductance cabling having first and second leads respectively metallically connected to said first and second rails near said muzzle end and being respectively connected to said rotor terminals.

6. Apparatus according to claim 5 which includes:

(a) first and second controlled switch means respectively connected in said first and second leads.

7. Apparatus according to claim 6 which includes:

(a) an augmenting winding in flux linking relationship with a predetermined portion of said rails;

(b) said augmenting winding being in series with said storage inductance.

8. Apparatus according to claim 1 which includes:

(a) a secondary inductor in flux linking relationship with said storage inductance;

(b) said switch means being in series with said secondary inductor;

(c) additional switch means connected in circuit between said secondary inductor and said switch means to allow current build up in said secondary inductor to launch said projectile when said additional switch means is closed;

(d) said means for recovering inductive energy includes a plurality of turns of a winding in flux linking relationship with said rails; and (e) said means for transferring includes relatively low inductance cabling connecting said winding with said rotor terminals, and controlled switch means for completing said connection.

9. Apparatus according to claim 1 wherein:

(a) said means for recovering includes resistive muzzle rail segments.

10. Apparatus according to claim 5 wherein:

(a) said energy storing inductance is symmetrically split in two, with each half being connected to a respective one of said rotor terminals.

11. A method of operating an electromagnetic projectile launcher having a homopolar generator-storage inductance current supply which injects a high current into a rail system having parallel conducting rails bridged by a projectile accelerating armature, comprising the steps of:

(a) recovering inductive energy remaining in said rail system after a projectile launch; and (b) transferring said recovered energy back to said homopolar generator to increase the kinetic energy of the rotor thereof.

12. A method according to claim 11 which includes the step of:

(a) inductively recovering said remaining energy by means of a rail flux linking winding.

13. A method according to claim 11 which includes the step of:

(a) commutatively recovering said remaining energy by means of a direct metallic connection between said rails near the muzzle, and said rotor.

* * * * *